US007319435B2

(12) United States Patent
Rauch

(10) Patent No.: US 7,319,435 B2
(45) Date of Patent: Jan. 15, 2008

(54) BALUN FOR AN ANTENNA

(75) Inventor: Charles T. Rauch, Barnesville, GA (US)

(73) Assignee: PDSEElectronics, Inc., Akron, OH (US)

( * ) Notice: Subject to any disclaimer, the term of this patent is extended or adjusted under 35 U.S.C. 154(b) by 104 days.

(21) Appl. No.: 10/932,476

(22) Filed: Sep. 1, 2004

(65) Prior Publication Data

US 2005/0052331 A1 Mar. 10, 2005

Related U.S. Application Data

(60) Provisional application No. 60/501,228, filed on Sep. 8, 2003.

(51) Int. Cl.
*H01Q 9/16* (2006.01)

(52) U.S. Cl. ..... 343/821; 343/905

(58) Field of Classification Search ..... 343/702, 343/713, 894, 895, 889, 797, 820, 821, 855, 343/905; 333/32–34, 25; 324/762
See application file for complete search history.

(56) References Cited

U.S. PATENT DOCUMENTS

| | | | | |
|---|---|---|---|---|
| 3,500,252 | A * | 3/1970 | Wakker | 333/131 |
| 3,618,105 | A * | 11/1971 | Bruene et al. | 343/747 |
| 5,619,172 | A * | 4/1997 | Reynolds | 333/25 |
| 5,767,754 | A * | 6/1998 | Menna | 333/25 |
| 5,920,292 | A * | 7/1999 | O'Neill, Jr. | 343/895 |
| 5,945,890 | A * | 8/1999 | McCorkle | 333/26 |
| 6,111,465 | A * | 8/2000 | Kakuta et al. | 330/276 |
| 6,229,327 | B1 * | 5/2001 | Boll et al. | 324/762 |
| 6,239,668 | B1 * | 5/2001 | Menna et al. | 333/25 |

* cited by examiner

*Primary Examiner*—Douglas W. Owens
*Assistant Examiner*—Jimmy Vu
(74) *Attorney, Agent, or Firm*—Renner, Kenner, Greive, Bobak, Taylor & Weber

(57) ABSTRACT

A balun used in high-power applications capable of accommodating a transmission line includes a core with a top surface and a bottom surface formed from soft iron material. At least two holes are provided through the core between the top surface and the bottom surface to accommodate at least one winding of the transmission line. For a given amount of core material and transmission line wound through the core, the balun serves to maximize the amount impedance on the outside surface of the transmission line to decrease the amount of electrical flux generated where the transmission line is attached to the transmission lines of an antenna.

15 Claims, 4 Drawing Sheets

BALUN FOR AN ANTENNA

CROSS-REFERENCE TO RELATED APPLICATION

This application claims the benefit of U.S. Provisional Application No. 60/501,228 filed on Sep. 8, 2003.

TECHNICAL FIELD

The present invention relates to an improved antenna balun.

BACKGROUND ART

Baluns are used to interface balanced systems to unbalanced systems, and to transition electrical energy therebetween. In fact, the word "balun" is derived from the "bal" of balanced and the "un" of unbalanced. Many antennas interface with a feedline having different balance characteristics. A dipole antenna is a common example where an inherently balanced antenna often uses unbalanced transmission lines for the feed line. As a result, when using a dipole antenna or other balanced antenna system, baluns are often added to transition balanced or nearly balanced terminal voltages of an antenna to unbalanced voltages of a feedline while maintaining equal and opposite currents at any instant of time in and out of the interface. The balun also transitions a balanced signal voltage transmitted or received by the antenna from or to the unbalanced voltage of a coaxial feed line.

Requirements for baluns and balanced to unbalanced interfaces are not limited or restricted to dipole antennas, antennas of other types, or transmission lines, but may also include transmission line to transmission line interfaces, generators, transmitters, receivers, and other devices that absorb, convey, or supply time-varying currents and voltages for transmission or reception of radio frequency energy. The more difficult situation is substantially improving wide frequency range radio communications systems by improving transitions between or among antennas and feedlines to transmitters and transmitter/receiver combinations, especially when the balun is used in a variety of unpredictable system constructions and operating conditions at modest-to-high power levels over wide frequency ranges. Higher power operation over wide frequency ranges with a wide variety of end-use conditions requires special care and consideration not available through traditional balun construction.

Although some baluns transform impedances when transitioning between balanced to unbalanced systems, the main function of a balun is to provide proper isolation of current paths and voltage differences between balanced and unbalanced voltage systems. As one example, the need for a balun, and the isolation of paths provided by the balun, is seen when the balanced voltages of dipole antenna feedpoints are attached to unbalanced voltages of a coaxial feed line. While this example is of a dipole antenna, balance and unbalance also applies to other antenna systems and feedlines, which always must be someplace between being perfectly balanced and perfectly unbalanced in voltages while generally requiring exactly equal and opposing currents for optimum performance or satisfactory operation. In this example, a first dipole arm and a second dipole arm form a balanced or nearly balanced voltage load for the transmission line. The first dipole arm or balanced load terminal is attached directly to the inner conductor of the coaxial cable and the second dipole arm is attached directly to the outer conductor of the coaxial cable.

When any balanced voltage or less than perfectly unbalanced voltage antenna system is operating without a balun and connected to an unbalanced voltage transmission line, a first current flows in one direction at one instant of time through the first dipole arm and the inner conductor. At the same instant of time a second opposite direction current flows oppositely along the inside wall of the coaxial outer conductor and a portion reaches and flows into the second dipole arm. However, a third unwanted current develops where the second dipole arm is attached to the outer conductor of the unbalanced feedline. In this dipole example, an electrical voltage appears at the attachment point for the second current, and this voltage causes a third current and unwanted voltage to be created along the outer surface (or shield) of the coaxial cable. That is, the desired transmission line power is divided into two power components. The first power or energy component flows to or from the desired place known as the antenna, and a second unwanted power component appears from an undesired third current and voltage along the outside of the shield. As a result, the desired power is effectively divided into an unwanted and harmful power caused by unwanted current and voltage in an undesired place.

The creation of the third unwanted current results in unwanted and undesired radiation or reception from the feed line, and undesired unequal currents in the dipole arms. Such radiation and unequal currents consume power from the energy transferred between the antenna and the receiver, generator, or transmitter system, and, therefore, decrease efficiency and performance of the entire system. However, the magnitude of the disturbance in voltages and undesired third current depends on the impedance of the outside surface of the coaxial cable and the voltage driving that unwanted current. For example, if the impedance of the surface of the coaxial cable, antenna, other transmission line, or load is very high, then the amount of electrical current generated at the above-described transition point is low, and, therefore, the amount of useful and wanted electrical power converted into an undesired and harmful power is low. Consequently, when the impedance on the outside surface of a coaxial cable is high, the power is not divided, and the third unwanted current is effectively eliminated. The same is true for a balanced transmission line connected to an unbalanced source, a radio transmitter being a source; or an unbalanced load, an antenna or other circuit being a common load.

Therefore, if the impedance of the outside surface of the coaxial cable can be increased, then the radiation from the feed line and the unequal currents and voltages in the dipole arms due to the third current can be eliminated as a problem. To that end, the purpose of the balun is to increase the impedance along the outside surface of the transmission line, restricting unwanted diversion of useful power to useless or harmful power at the transition point.

Three configurations of baluns have traditionally been used in high-power transmitting antennas used over wide frequency ranges. The first configuration was popularized by Walter Maxwell, and consists of a plurality of ferrite beads strung over the feed line. The second configuration was popularized by Jerry Sevik, and consists of a transmission line wound through and around a magnetically soft iron toroid. The third configuration, the air-core balun, is a basic coil or winding of wire wound in a hollow circle with or without a supporting form.

However, because the desired impedance increase provided by the core-type baluns depends almost totally on the amount of transmission line passing through the core of the baluns, the Maxwell and Sevik baluns have inherent limitations. The air-core balun is also severely limited, because good performance requires a large and bulky construction, which restricts bandwidth and wastes space. Moreover, the Maxwell balun wastes core material because the transmission line passes only once through the holes provided in the ferrite beads. One unit length of bead only provides one unit increase of impedance. Furthermore, the Sevik balun concept, while making good use of the core, wastes transmission line length because for every wind around the toroid, the transmission line passes only once through the hole of the toroid. Most of the transmission line is outside the desired magnetic field concentrations of the core. As a result, there is a need for a balun that minimizes the relative amount of transmission line and core material necessary, and at the same time greatly maximizes the amount of desired isolating impedance on the outside ends of the balun while maintaining very wide bandwidth.

DISCLOSURE OF THE INVENTION

In general, the present invention contemplates a balun used in high-power applications capable of accommodating a transmission line having a core with a top surface and a bottom surface, where at least two holes are provided through the core between the top surface and the bottom surface to accommodate at least one winding of the transmission line.

The present invention further contemplates a balun for accommodating a transmission line, and interfacing an antenna with a high-power transmitter, having a core with at least two holes formed therethrough, and at least one rib formed between the two holes to accommodate at least one winding of the transmission line.

The present invention still further contemplates an antenna interfaced by a balun with a transmission line, the antenna having a first dipole transmission line and a second dipole transmission line isolated by insulators, and the balun having a core with at least two holes formed therethough and at least one rib formed between the at least two holes, wherein at least one winding of transmission line is wound around the rib.

A preferred exemplary balun according to the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
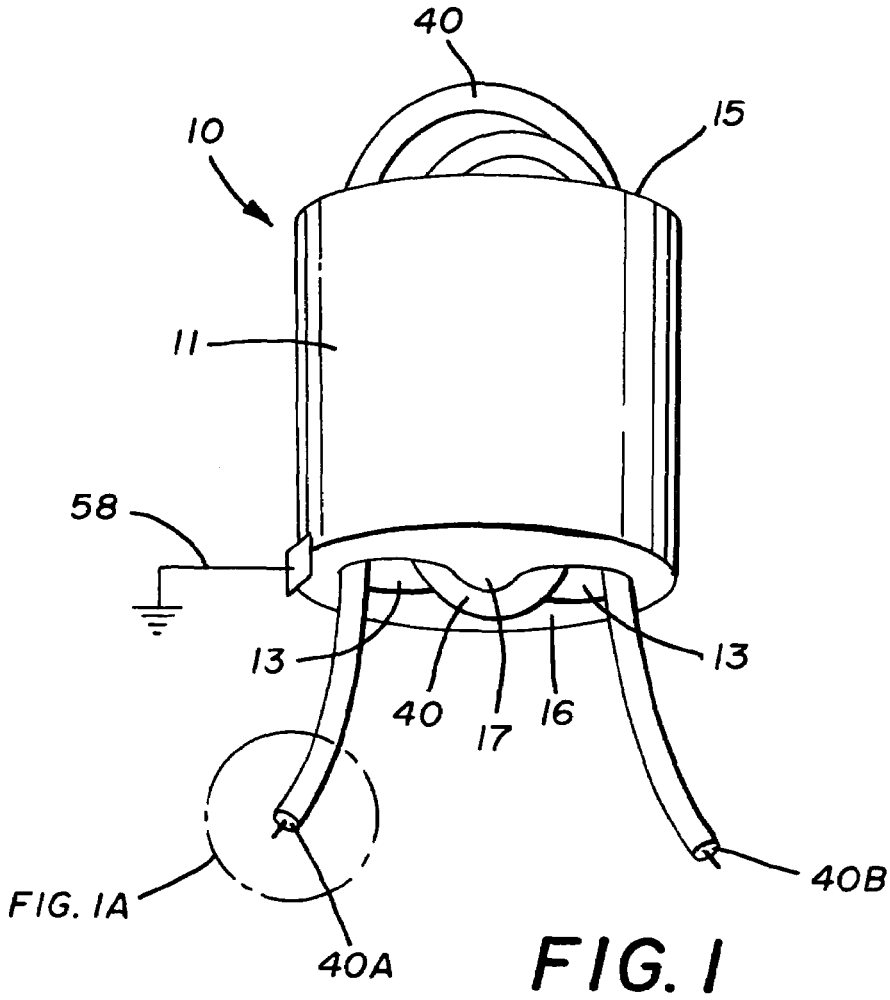
FIG. 1 is a perspective view of one embodiment of a balun made in accordance with the present invention.
Figure 2:
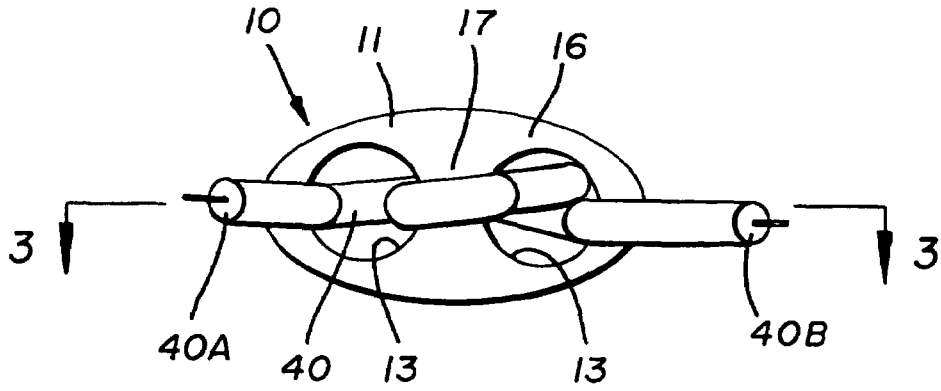
FIG. 2 is a bottom plan view of the balun of FIG. 1.
Figure 3:
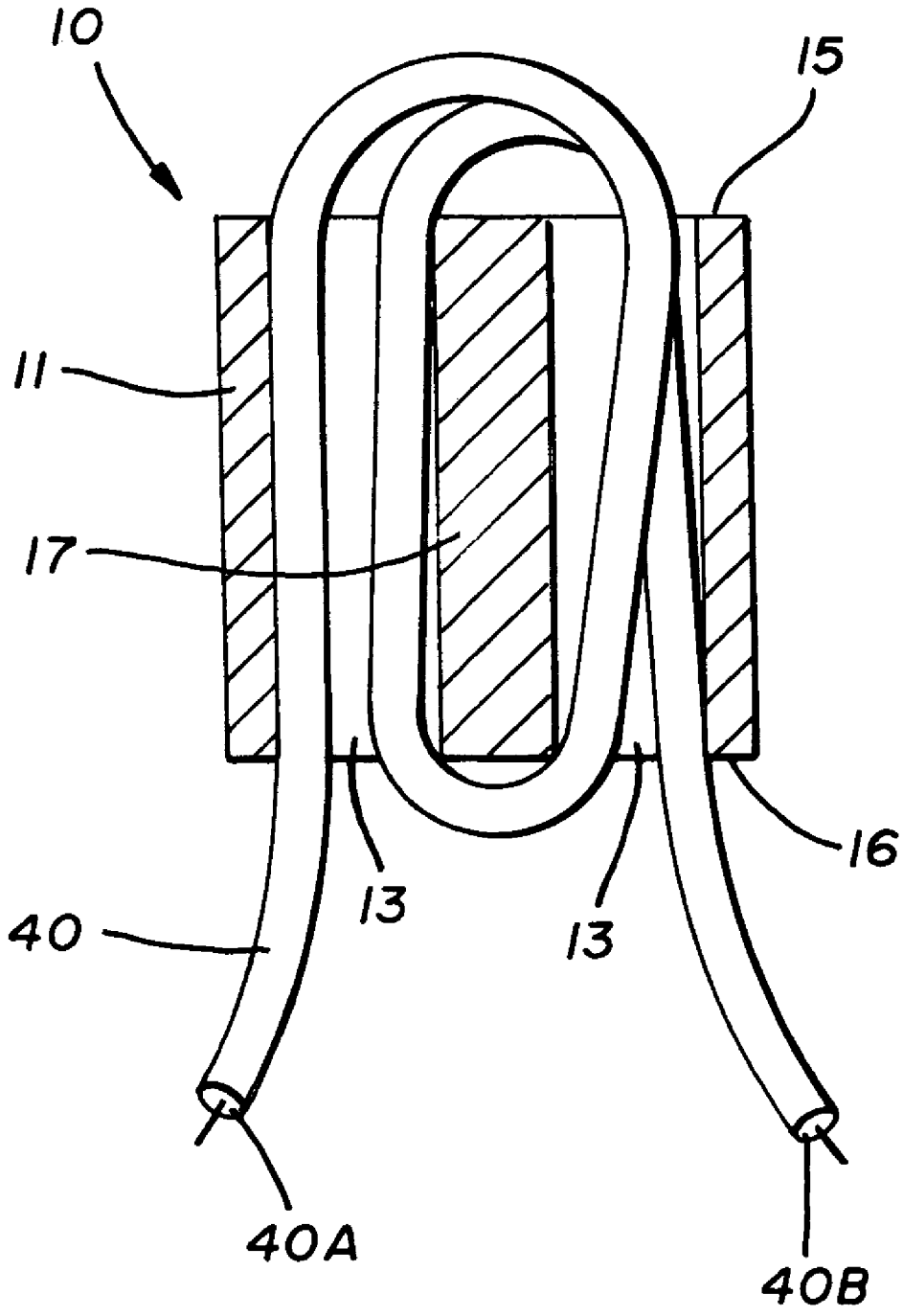
FIG. 3 is a sectional view taken substantially along line 3-3 of FIG. 2.

As seen in FIGS. 1-3, a balun made in accordance with one embodiment of the present invention is generally indicated by the numeral 10. Balun 10 is especially constructed for high-power (i.e. greater than 500 watts) receiving and/or transmitting applications, and has a core 11 constructed of a solid piece of soft iron material. Core 11 is preferably constructed of ferrite, but core 11 could also be constructed of powdered iron or any other magnetically soft iron. Core 11 has a compressed cylindrical shape as best seen in FIG. 1, but could have other shapes provided that core 11 can accommodate binocular holes 13.

Binocular holes 13 extend through core 11 from top surface 15 to bottom surface 16. Binocular holes 13 are shown as being cylindrical but could have any shape provided that binocular holes 13 are able to accommodate a transmission line 40 of an antenna. Transmission line 40 is wound through binocular holes 13 and around a rib 17 formed between binocular holes 13.

As best seen in FIG. 3, transmission line 40 enters one binocular hole 13 at bottom surface 16, is wrapped around rib 17, and exits through the other binocular hole 13 at bottom surface 16. Ultimately, one end (indicated by the numeral 40A) of transmission line 40 will be attached to the lines of an antenna, and another end (indicated by the numeral 40B) of transmission line 40 will be attached to a receiver or transmitter 41 (FIG. 1B).

Figure 1A:
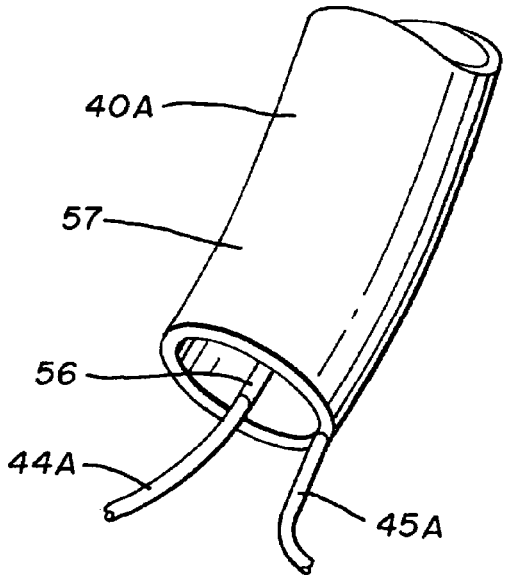
FIG. 1A is an enlarged view of a portion of FIG. 1.
Figure 1B:
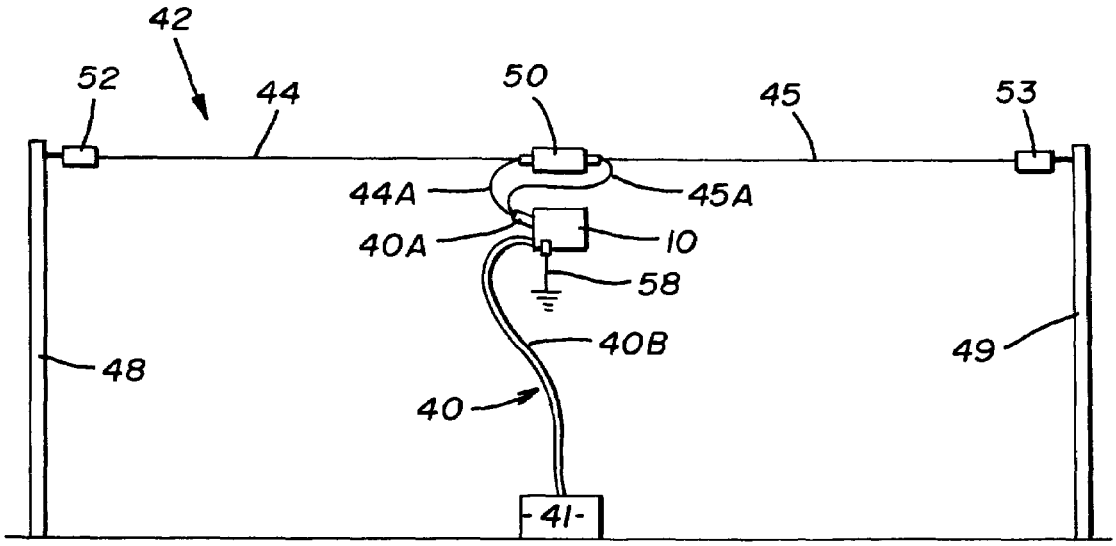
FIG. 1B is a schematic view of a dipole antenna system employing the embodiment of the balun of FIG. 1.

For example, balun 10 can be used to connect a dipole antenna generally indicated by the numeral 42 in FIG. 1B to an unbalanced coaxial cable used as transmission line 40. Dipole antenna 42 is a balanced system formed by stringing a first dipole transmission line (or first dipole arm) 44 and a second dipole transmission line (or second dipole arm) 45 of equal length in opposite directions.

While balun 10 can be used to interface balanced systems (such as dipole antenna 42) with unbalanced systems (such as the unbalanced coaxial cable used as transmission line 40), balun 10 can also be used to interface balanced systems with balanced systems. For example, the balun 10 could be used with dipole antenna 42 and a transmission line 40 which is balanced. Moreover, although balun 10 is shown in FIG. 1B as being used with dipole antenna 42, balun 10 can be used with any number of antennas including, but not limited to, vertical antennas.

As seen in FIG. 1B, first and second dipole transmission lines 44 and 45 of dipole antenna 42 are configured to form a straight line with, as seen in FIG. 1B, first dipole transmission line 44 extending to the left (to be supported by a post 48) and second dipole transmission line 45 extending to the right (to be supported by a post 49). Transmission lines 44 and 45 are interconnected by a central insulator 50, and from their respective support posts 48 and 49 by insulators 52 and 53. Central insulator 50 and insulators 52 and 53 isolate first and second dipole transmission lines 44 and 45 from one another and the surrounding environment.

Even though dipole antenna 42 is a balanced system, balun 10 allows transmission line 40 which is an unbalanced coaxial cable (having an inner conductor 56 and an outer conductor 57) to be used. Transmission line 40, as discussed above, is wound through the interior of balun 10. As such, the transmission line 40 includes one end 40A attached to the transmission lines 44 and 45, and another end 40B which extends from balun 10 to serve as a feedline connected to the receiver or transmitter 41. As seen in FIG. 1A, at end 40A, first dipole transmission line 44 is connected via an intermediate line 44A to inner conductor 56, and second dipole transmission line 45 is connected via an intermediate line 45A to outer conductor 57 of transmission line 40. Moreover, balun 10 can be optionally grounded at 58 depending on the application requirements. Balun 10 serves to, as discussed above, transition balanced or nearly balanced terminal voltages of dipole antenna 42 to the unbalanced voltages of transmission line 40, while maintaining equal and opposite currents at any instant of time in and out of the interface.

Figure 4:
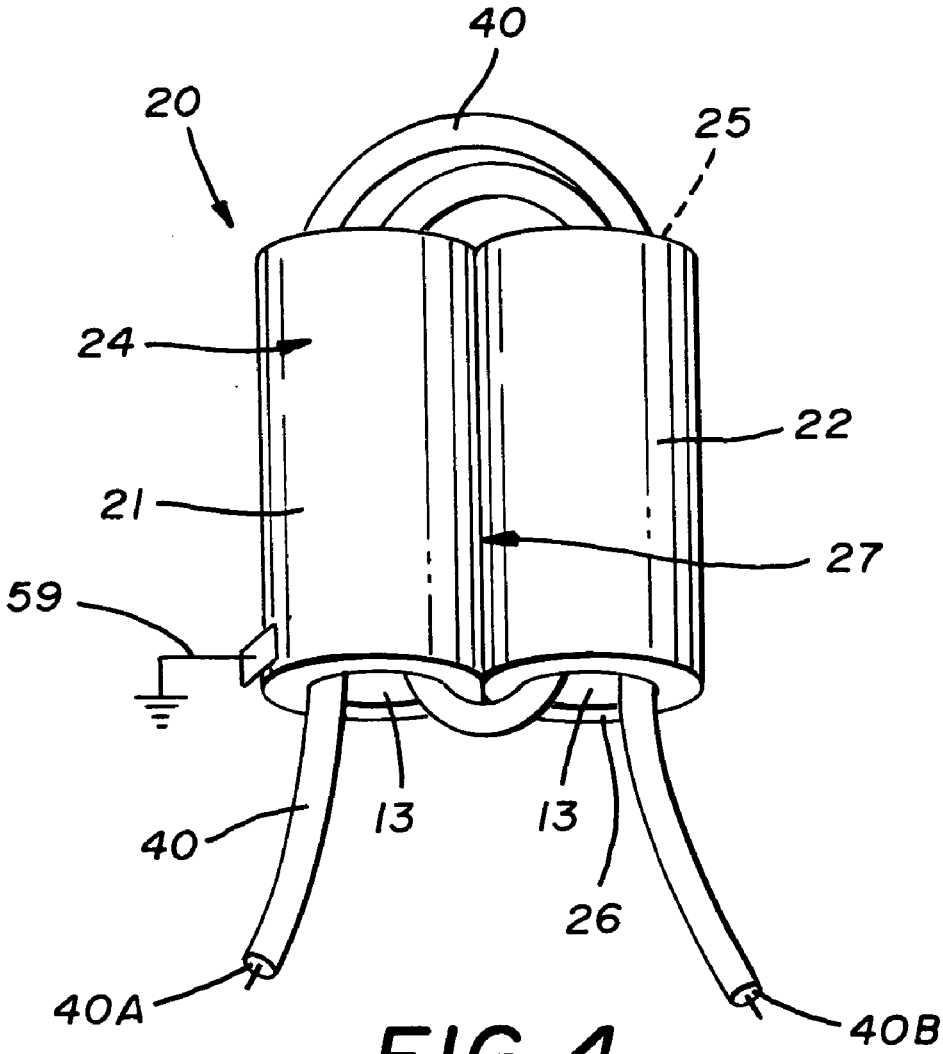
FIG. 4 is a perspective view of the another embodiment of a balun made in accordance with the present invention.
Figure 5:
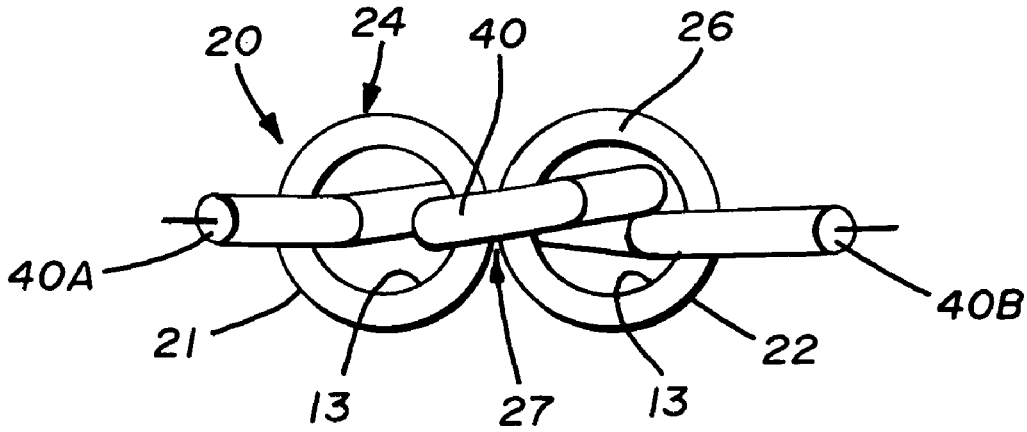
FIG. 5 is a bottom plan view of the balun of FIG. 4.

Another embodiment of a balun according to the instant invention is generally indicated by the numeral 20 in FIGS. 4 and 5. Like balun 10, balun 20 is especially constructed for high-power receiving and/or transmitting applications, and is formed from soft iron material such as ferrite. Balun 20 includes a first hollow cylinder 21 and a second hollow cylinder 22 which are aligned parallel to one another, and are attached together along the interface of their exterior surfaces to form a core 24. First and second hollow cylinders 21 and 22 have binocular holes 23 which are cylindrical and which share the same axis with their respective cylinders 21 and 22.

When first and second hollow cylinders 21 and 22 are attached together, top and bottom surfaces 25 and 26 of core 24 take on a figure eight shape. A wall 27 is formed where first and second hollow cylinders 21 and 22 are attached to one another. Like the first embodiment, transmission line 40 is wound through binocular holes 23 and around wall 27. For example, transmission line 40 enters one binocular hole 23 at bottom surface 26, is wrapped around wall 27, and exits through the other binocular hole 23 at bottom surface 26. Ultimately, one end 40A of transmission line 40 will be attached to the lines of an antenna (such as dipole antenna 42) and the other end 40B will serve as a feedline which is attached to the receiver or transmitter 41. As seen in FIG. 4, balun 20 be optionally grounded at 59 depending on the application requirements.

Baluns 10 and 20 act to prohibit the above-described third current from developing by increasing the impedance of the outer surface of the transmission line 40. For example, when the impedance of the outside surface of the transmission line is high, the third current is effectively eliminated. That is, if the impedance of the outside surface of the transmission line is high, then the amount of electrical flux generated where the transmission line 40 is attached to the transmission lines is low, and, therefore, the amount of electrical flux converted into the third current is low.

The amount of the impedance increase provided by baluns 10 and 20 depends on the length of transmission line 40 wound inside cores 11 and 24. When using baluns 10 and 20, the winding style of transmission line 40 places most of transmission line 40 inside cores 10 and 20. This winding style minimizes the relative amount of transmission line and core material necessary as compared to the Maxwell and Sevik baluns by maximizing the amount transmission line wound inside the cores. In other words, because the length of transmission line 40 wound around baluns 10 and 20 is concentrated inside the cores 11 and 24, the relative length of transmission line 40 is reduced. As a result, for a given amount of transmission line and core material, baluns 10 and 20 maximize the amount impedance on the outside surface of the transmission line.

The manner in which the present invention improves the art is based on the relationship between the impedance increase and the length of transmission line 40 concentrated inside the cores 11 and 24. Regarding the Maxwell balun, doubling the number of the ferrite beads doubles the length of the transmission line passing through the holes in the ferrite beads, but results only in doubling the amount of the impedance increase. However, in baluns 10 and 20, winding transmission line 40 around cores 11 and 24 a second time doubles the length of transmission line 40 required, but effectively quadruples the amount of the impedance increase. As such, the amount of impedance on the outside surface of the transmission line 40 of baluns 10 and 20 increases by the square of the number of the windings of transmission line 40 around cores 11 and 24.

Furthermore, further impedance increases can be provided by increasing the number of holes in core 11 or increasing the number of hollow cylinders making up core 24. For example, if core 11 were provided with an increased number of holes, then transmission line 40 could be wound in, out, and around these holes. Therefore, by increasing the number of holes, the length of transmission line 40 concentrated inside core 11 would be further maximized. Furthermore, if core 24 was provided with an increased number of hollow cylinders, then transmission line 40 could also be wound in, out, and around the holes of these hollow cylinders, and the length of transmission line 40 concentrated inside core 11 would be further maximized.

While in accordance with the patent statutes, only the best mode and preferred embodiment has been presented and described in detail, it is to be understood that the invention is not limited thereto or thereby.

What is claimed is:

1. A transmitting system comprising:

a transmitter that generates signals having a power greater than about 500 watts;

an antenna to transmit signals generated by said transmitter;

a balun including a core having a top surface and a bottom surface, and at least two holes provided through said core between said top surface and said bottom surface to accommodate at least one winding of a transmission line, said transmission line having one end coupled to said transmitter, and the other end coupled to said antenna.

2. The transmitting system according to claim 1, wherein said core has a compressed cylindrical shape, and a rib formed between said holes.

3. The transmitting system according to claim 2, wherein said at least one said winding of said transmission line is wound around said rib, said transmission line entering one of said holes and exiting the other of said holes.

4. The transmitting system according to claim 2, wherein said antenna comprises a dipole antenna.

5. The transmitting system according to claim 1, where said core is constructed of ferrite.

6. The transmitting system according to claim 1, wherein said core is formed from at least two hollow cylinders attached together defining at least two holes therethrough.

7. The transmitting system according to claim 6, wherein a first hollow cylinder and a second hollow cylinder are attached together, said first hollow cylinder and said second hollow cylinder defining said holes and a wall formed between said holes.

8. A receiving system comprising:

a receiver that is configured to receive signals having a power greater than about 500 watts;

an antenna to receive said signal;

a balun including a core having a top surface and a bottom surface, and at least two holes provided through said core between said top surface and said bottom surface to accommodate at least one winding of a transmission line, said transmission line having one end coupled to said receiver, and the other end coupled to said antenna.

9. The receiving system according to claim 8, wherein said core has a compressed cylindrical shape, and a rib formed between said holes.

10. The receiving system according to claim 8, wherein said core is constructed of ferrite.

11. The receiving system according to claim 8, wherein said core is formed from at least two hollow cylinders attached together defining at least two holes therethrough.

12. The receiving system according to claim 11, wherein a first hollow cylinder and a second hollow cylinder are attached together, said first hollow cylinder and said second hollow cylinder defining said holes and a wall formed between said holes.

13. The receiving system according to claim 8, wherein said antenna comprises a dipole antenna.

14. A method of transmitting a high power signal comprising the steps of:

providing a transmitter configured to transmit signals having a power greater than about 500 watts;

providing an antenna;

providing a balun comprising:

a core having a top surface and a bottom surface, and at least two holes provided through said core between said top surface and said bottom surface to accommodate at least one winding of a transmission line; and coupling one end of said transmission line to said transmitter and the other end of said transmission line to said antenna.

15. The method of claim 14, wherein said antenna comprises a dipole antenna.

* * * * *